US006059634A

United States Patent [19]

Fildan

[11] Patent Number: 6,059,634

[45] Date of Patent: May 9, 2000

[54] BRASSIERE-STRAP SLIDE

[76] Inventor: Gerhard Fildan, Dr. Körner Str. 64, A-2521, Trumau, Austria

[21] Appl. No.: 09/189,364

[22] Filed: Nov. 9, 1998

[51] Int. Cl.[7] ..... A41C 3/00; A44B 1/04

[52] U.S. Cl. ..... 450/86; 450/1; 24/200; 24/197; 24/198

[58] Field of Search ..... 450/86, 1, 18, 450/25, 63, 64, 88, 93; 24/197, 198, 200; 2/67, 336, 338, 312, 313, 314, 315, 320, 321, 326, 323, 335, 268, 271

[56] References Cited

U.S. PATENT DOCUMENTS

| | | | |
|---|---|---|---|
| 2,224,773 | 12/1940 | Shaulson | 24/200 |
| 2,260,060 | 10/1941 | Shaulson | 24/200 |
| 3,075,268 | 1/1963 | Schwartz | 24/200 |
| 3,077,650 | 2/1963 | Horne | 24/200 |
| 3,112,750 | 12/1963 | Jonas | 24/200 |
| 3,115,878 | 12/1963 | Markham | 24/200 |
| 3,161,931 | 12/1964 | Zif | 24/200 |
| 3,164,154 | 1/1965 | Simonsen | 24/200 |
| 3,290,696 | 12/1966 | Rosenzweig | 2/323 |
| 5,590,443 | 1/1997 | Fildan | 24/200 |

*Primary Examiner*—Gloria M. Hale
*Attorney, Agent, or Firm*—Herbert Dubno

[57] ABSTRACT

A brassiere slide has a groove along the body side flank of each limb which delimits a pair of longitudinal edges which are engaged by the strap as it passes along one flank behind the crossbar and then along the other flank also with similar edges. In this system, there is a reduced tendency for the slider to shift autogenously along the strap.

14 Claims, 2 Drawing Sheets

FIG. 1
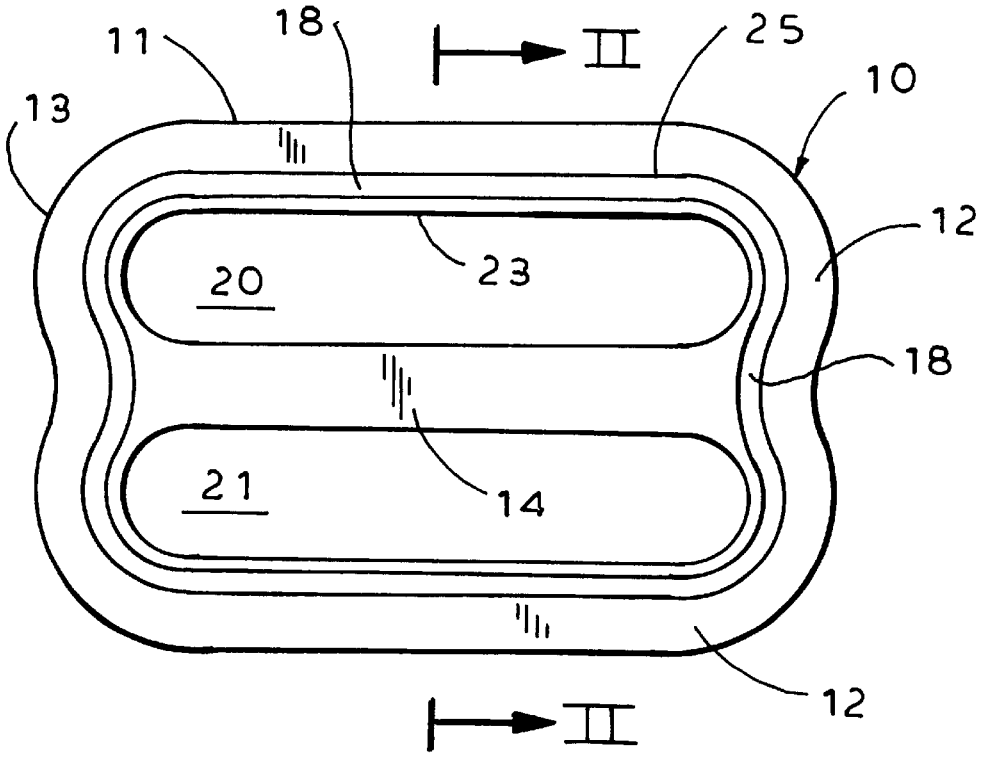
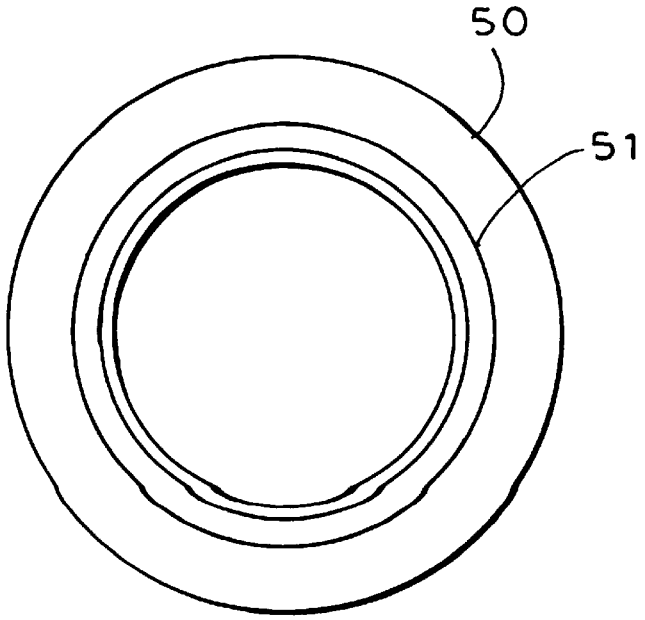
FIG. 5

BRASSIERE-STRAP SLIDE

SPECIFICATION

1. Field of the Invention

My present invention relates to a brassiere strap slide or a brassiere strap assembly having a slide with improved retention of the strap against slipping. While the description here is directed to brassieres, it will be understood that such a slide may be utilized on other articles of lingerie and even in swimsuit or other garment applications and the invention is deemed to apply to those as well.

2. Background of the Invention

A typical brassiere strap slide comprises two slots through which a brassiere strap is guided behind a crossbar over which a loop of a strap may be permanently engaged. Adjustments of the strap are effected by releasing the tension on the strap and sliding the slider upwardly or downwardly along the strap. When the strap is somewhat elastic and/or when the brassiere is stressed because, for example, the wearer may be running or jogging or may be a heavy-breasted individual, the alternating tightening and relaxation of the strap tends to cause the slider to move involuntarily along the strap and the brassiere to loosen. That, of course, requires readjustment of the strap by the user.

Efforts have been made to limit slipping of the slides and these have included various forms of serrations to increase the friction between the slides and the strap. The strap itself may be made of rougher or less flexible material, to the detriment of comfort or aesthetics. Serrated surfaces tend to catch in the garment of the wearer and may cause early deterioration of the strap. By and large, therefore, it can be said that earlier techniques with respect to limiting the slip of a brassiere slider on the brassiere strap have not been successful.

OBJECTS OF THE INVENTION

It is, therefore, the principal object of the present invention to provide an improved brassiere strap slide which will overcome these drawbacks and remain stably in position, even when the strap is composed of a material with a slippery finish, and even when the strap is subject to alternating tensioning and relaxation.

Another object of this invention is to provide a brassiere strap assembly with improved capacity for retaining its position and originally set tension.

It is still another object to provide a slider for garments and especially the purposes described which can be free from the drawbacks of earlier systems.

SUMMARY OF THE INVENTION

I have found, quite surprisingly, that by providing along the flanks of the slider limbs over which the strap passes, a pair of longitudinal edges, one close to the slot of that limb and the other set back slightly from that slot, I can drastically reduce the tendency of the strap to slip along the slider or the slider along the strap.

The two edges along the edge flank can be defined by a longitudinal groove which lies inwardly from the slot but parallel thereto and defines the two edges in the respective flank.

More particularly, the brassiere slide of the invention can comprise a slide body having an elongated outer frame with a pair of mutually parallel longitudinal frame limbs, a pair of transverse frame limbs connecting the outer frame limbs, and a crossbar between the transverse frame limbs and parallel to the longitudinal frame limbs, the body being formed with a respective oval slot between the crossbar and each of the longitudinal frame limbs whereby a brassiere strap is adapted to pass across a flank of one of the longitudinal frame limbs, through one of the slots, behind the crossbar, through the other of the slots and across a corresponding flank of the other of the longitudinal frame limbs, the flanks each being formed with a laterally projecting longitudinal edge adjoining the respective slot and a further longitudinal edge spaced inwardly along the respective flank from the laterally projecting longitudinal edge, so that the strap while tension is retained against slip by the edges on both the flanks.

According to a feature of the invention the loop of the strap is secured around the crossbar and the strap can pass through a ring connecting it with a cup of the brassiere.

Advantageously, each further edge is separated from the laterally projecting edge for each of the flanks by a continuous outwardly open groove formed in the limbs of the frame around the slots.

A similar groove may be provided in that ring so that the ring can aesthetically match the slider.

The body can be formed with corresponding flanks, edges and grooves symmetrically along opposite faces thereof and it has been found to be of advantage also to taper the flanks of the longitudinal frame limbs so that they converge toward the outer perimeter of the slide. The inner side of each longitudinal limb, delimiting the respective slot, can be formed with two bevels outwardly, preferably at angles of about 8°.

The slide of the present invention has aesthetic advantages since the groove which delimits the two notches affords a unique appearance to the slide and the ring. In fact, the slide appears smaller than it is in practice because of the presence of the groove. The two edges on each flank have been found to contribute significantly to the lack of slip of the slide along the strap, so much so that serration of the edges is not necessary. The unit is economical because it can be injection-molded easily.

BRIEF DESCRIPTION OF THE DRAWING

The above and other objects, features, and advantages will become more readily apparent from the following description, reference being made to the accompanying drawing in which:

FIG. 1 is a plan view of a slide for a brassiere strap or like garment strap;

FIG. 5 is an elevational view of that ring.

SPECIFIC DESCRIPTION

Figure 2:
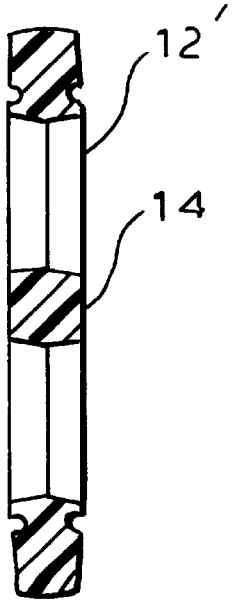
FIG. 2 is a cross sectional view along the line II—II of FIG. 1.

As can be seen from FIGS. 1 and 2, the slide basically comprises a frame-shaped body 10 with a pair of longitudinal limbs 11 and 12 bridged by a pair of transverse limbs 12' and 13 which are shown to have sinusoidal shapes. The transverse limbs 12' and 13 are bridged by a crossbar 14. According to the invention, in each of the flanks 15 and 16 of the longitudinal limbs 11 and 12, there is recessed a respective groove 17, 18 which extends all around the frame to surround the longitudinal slots 20 and 21 thereof. The grooves 17 and 18 define a pair of inner edges 22 and 23 and a pair of outer edges 24, 25, each flank having two such longitudinal edges to engage a strap. The flanks 15 and 16 are tapered downwardly at an angle α of approximately 5° while the side of the limb bordering its slot 20, 21 is beveled at 30 to form an angle β which can be about 8°.

Figure 3:
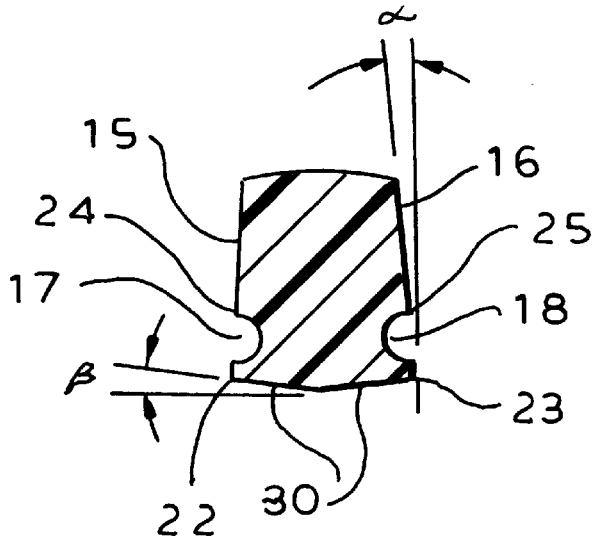
FIG. 3 is a detail view of a section through one of the longitudinal limbs.
Figure 4:
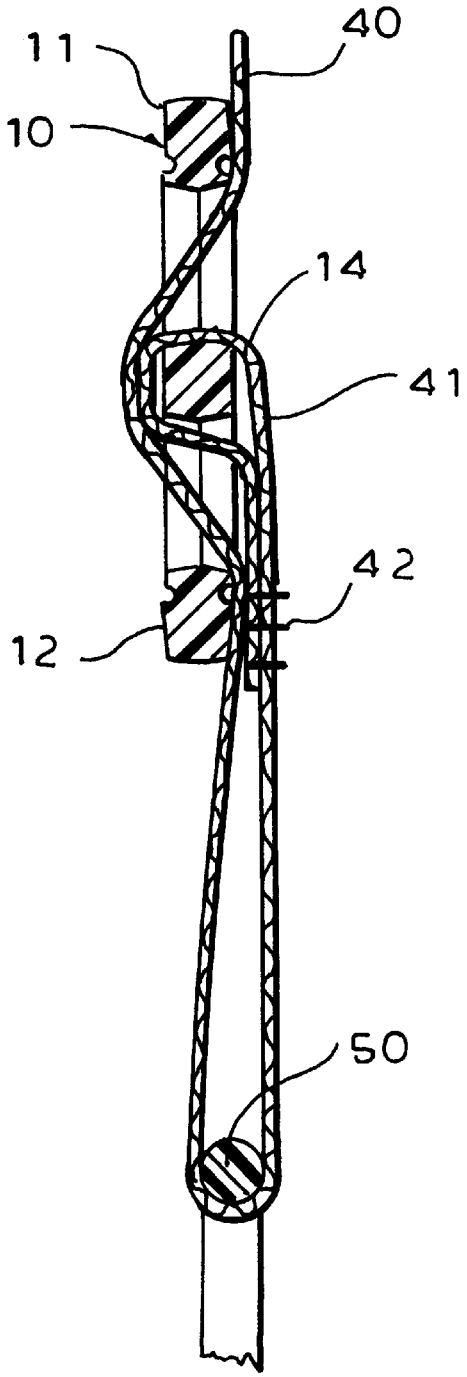
FIG. 4 is a cross sectional view showing the strap pattern in the slide and connection of the ring of the brassiere cup.

As has been shown in FIG. 4, a stretch 40 of a strap can pass initially along the body side flank 16 of the limb 11, then around the crossbar 14 and then across the body side flank of limb 12' before being engaged in a ring 50 connected to the brassiere cup. The stretch 40 runs from the shoulder strap. The strap also has a loop 41 secured by stretch 42 around the crossbar 14. As can be seen from FIG. 5, the ring 50 can be formed with a groove 51 which is similar to the groove 17 or the groove 18 so that the ring can match the slide.

In FIG. 4 the left side of the slider 10 shown in FIG. 4 is a side turned away from the body. Experience has shown that with a groove 17 or 18 with a depth of say 0.25 mm, the edges do not pose a danger to the outer garments of the wearer. The taper of the flanks 15 and 16 ensures that by and large the slider will sit off of the skin of the wearer and hence there is a material comfort increase.

I claim:

1. A brassiere-strap slide comprising a slide body having an elongated outer frame with a pair of mutually parallel longitudinal frame limbs, a pair of transverse frame limbs connecting said outer frame limbs, and a crossbar between said transverse frame limbs and parallel to said longitudinal frame limbs, said body being formed with a respective oval slot between said crossbar and each of said longitudinal frame limbs whereby a brassiere strap is adapted to pass across a flank of one of said longitudinal frame limbs, through one of said slots, behind said crossbar, through the other of said slots and across a corresponding flank of the other of said longitudinal frame limbs, said flanks each being formed with a laterally projecting longitudinal edge adjoining the respective slot and a further longitudinal edge spaced inwardly along the respective flank from the laterally projecting longitudinal edge, so that said strap while tensioned is retained against slip by the edges on both said flanks.

2. The brassiere-strap slide defined in claim 1 wherein a loop of said strap is secured around said crossbar.

3. The brassiere-strap slide defined in claim 2 wherein said further edge is separated from said laterally projecting edge for each of said flanks by a continuous outwardly open groove formed in said limbs of said frame around said slots.

4. The brassiere-strap slide defined in claim 3 wherein said body is formed with corresponding flanks, edges and grooves symmetrically along opposite faces of said body.

5. The brassiere-strap slide defined in claim 4 wherein said flanks of each of said longitudinal frame limbs converge toward the outer perimeter of the frame.

6. The brassiere-strap slide defined in claim 5 wherein each of said flanks forms an angle of about 5° with a plane of the slide.

7. The brassiere-strap slide defined in claim 6 wherein each of said longitudinal frame limbs has an inner peripheral side delimiting the respective slot and beveled outwardly to the respective laterally projecting edge.

8. A brassiere-strap assembly comprising:

a brassiere-strap slide comprising a slide body having an elongated outer frame with a pair of mutually parallel longitudinal frame limbs, a pair of transverse frame limbs connecting said outer frame limbs, and a crossbar between said transverse frame limbs and parallel to said longitudinal frame limbs, said body being formed with a respective oval slot between said crossbar and each of said longitudinal frame limbs;

a brassiere strap having a loop secured onto said cross bar and a stretch passing across a flank of one of said longitudinal frame limbs, through one of said slots, behind said crossbar, through the other of said slots and across a corresponding flank of the other of said longitudinal frame limbs, said flanks each being formed with a laterally projecting longitudinal edge adjoining the respective slot and a further longitudinal edge spaced inwardly along the respective flank from the laterally projecting longitudinal edge, so that said strap while tensioned is retained against slip by the edges on both said flanks; and a ring connectable to a brassiere cup and traversed by said stretch.

9. The brassiere-strap assembly defined in claim 8 wherein said further edge is separated from said laterally projecting edge for each of said flanks by a continuous outwardly open groove formed in said limbs of said frame around said slots, said ring having a similar groove around an inner periphery thereof.

10. The brassiere-strap assembly defined in claim 9 wherein said body is formed with corresponding flanks, edges and grooves symmetrically along opposite faces of said body.

11. The brassiere-strap assembly defined in claim 10 wherein said flanks of each of said longitudinal frame limbs converge toward the outer perimeter of the frame.

12. The brassiere-strap assembly defined in claim 11 wherein each of said flanks forms an angle of about 5° with a plane of the slide.

13. The brassiere-strap assembly defined in claim 12 wherein each of said longitudinal frame limbs has an inner peripheral side delimiting the respective slot and beveled outwardly to the respective laterally projecting edge.

14. The brassiere-strap assembly defined in claim 13 wherein the bevel is at an angle of about 8°.

* * * * *